US011053049B1

(12) United States Patent
Inyang

(10) Patent No.: US 11,053,049 B1
(45) Date of Patent: Jul. 6, 2021

(54) SIZE ADJUSTABLE BOX

(71) Applicant: Idongesit Elijah Inyang, Columbus, OH (US)

(72) Inventor: Idongesit Elijah Inyang, Columbus, OH (US)

( * ) Notice: Subject to any disclaimer, the term of this patent is extended or adjusted under 35 U.S.C. 154(b) by 0 days.

(21) Appl. No.: 16/530,279

(22) Filed: Aug. 2, 2019

Related U.S. Application Data

(60) Provisional application No. 62/714,021, filed on Aug. 2, 2018.

(51) Int. Cl.
*B65D 21/08* (2006.01)

(52) U.S. Cl.
CPC ..... *B65D 21/086* (2013.01)

(58) Field of Classification Search
CPC .... B65D 21/086; B65D 21/08; B65D 21/083; B65D 88/005
USPC ..... 220/8
See application file for complete search history.

(56) References Cited

U.S. PATENT DOCUMENTS

| | | | | |
|---|---|---|---|---|
| 1,858,179 A | | 5/1932 | Bay | |
| 2,627,801 A | | 2/1953 | Danziger | |
| 2,664,258 A | * | 12/1953 | Lanier | B65D 15/24 248/172 |
| 2,707,587 A | | 5/1955 | Wittstein | |
| 2,948,624 A | * | 8/1960 | Watson | B65D 21/08 426/111 |
| 3,463,343 A | * | 8/1969 | Asenbauer | B65D 21/086 220/8 |
| 3,598,303 A | | 8/1971 | Folz | |
| 3,672,558 A | | 6/1972 | Johnson | |
| 3,727,827 A | | 4/1973 | Stice | |
| 4,136,817 A | | 1/1979 | Perry | |
| 4,759,495 A | | 7/1988 | Moon | |
| 5,016,772 A | * | 5/1991 | Wilk | B65D 21/086 220/495.01 |
| 5,192,019 A | | 3/1993 | Meehan | |
| 6,227,438 B1 | | 5/2001 | Hiltke | |
| 6,709,078 B2 | * | 3/2004 | Johnson | A47B 45/00 248/924 |
| 7,455,214 B2 | | 11/2008 | Miller et al. | |

(Continued)

FOREIGN PATENT DOCUMENTS

EP 2130683 B1 12/2012

OTHER PUBLICATIONS

20"×20"×20" Variable Depth Corrugated Box, EcoBox Website, Web page <http://www.ecobox.com/Shipping-Supplies/Variable-Depth/20-x-20-x-20-Variable-Depth-Corrugated-Box>, 1 page, dated at least as early as Aug. 14, 2018, retrieved from website on Oct. 4, 2020.

*Primary Examiner* — Shawn M Braden
(74) *Attorney, Agent, or Firm* — The Law Office of Patrick F. O'Reilly III, LLC

(57) ABSTRACT

A size adjustable box is disclosed herein. The size adjustable box includes a plurality of box sections slidably adjustable relative to one another, the plurality of box sections configured to collectively define a box interior and an upper box rim; and a plurality of lid sections slidably adjustable relative to one another, the plurality of lid sections configured to be received on the upper box rim so as to generally enclose the box interior. The slidable adjustability of the plurality of box sections and the plurality of lid sections allows a user to adjust an overall size of the box.

20 Claims, 10 Drawing Sheets

(56) References Cited

U.S. PATENT DOCUMENTS

| | | | | |
|---|---|---|---|---|
| 9,884,702 | B1 * | 2/2018 | Burns | A63C 11/026 |
| 10,501,232 | B1 * | 12/2019 | Price | B65D 21/083 |
| 2007/0241172 | A1 | 10/2007 | Miller et al. | |
| 2017/0043905 | A1 | 2/2017 | Matias | |

* cited by examiner

Detail "A"

Section A-A

SIZE ADJUSTABLE BOX

CROSS-REFERENCE TO RELATED APPLICATIONS

This patent application claims priority to, and incorporates by reference in its entirety, U.S. Provisional Patent Application No. 62/714,021, entitled "Size adjustable box", filed on Aug. 2, 2018.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a size adjustable box. More particularly, the invention relates to a size adjustable box that enables a user to adjust the dimensions of the box to fit a particular application.

2. Background

Conventional boxes do not allow for flexibility and convenience because they are not made to be adjustable to fit the needs of a particular user. As a result, the user will have to either go find more boxes to carry their items or buy different sized boxes. This is a problem because it is space consuming as well as time consuming for the user. Also, these conventional boxes can be less secure because they may require tape and can easily fall apart or break down easily.

Therefore, what is needed is a size adjustable box that can be customized by a user to store items safely and securely. Moreover, a size adjustable box is needed that allows a user to easily expand and reduce the dimensions of the box. Furthermore, what is needed is a size adjustable box that is able to be adapted for use in a myriad of different applications.

BRIEF SUMMARY OF EMBODIMENTS OF THE INVENTION

Accordingly, the present invention is directed to a size adjustable box that substantially obviates one or more problems resulting from the limitations and deficiencies of the related art.

In accordance with one or more embodiments of the present invention, there is provided a size adjustable box that includes a plurality of box sections slidably adjustable relative to one another, the plurality of box sections configured to collectively define a box interior and an upper box rim; and a plurality of lid sections slidably adjustable relative to one another, the plurality of lid sections configured to be received on the upper box rim so as to generally enclose the box interior. The slidable adjustability of the plurality of box sections and the plurality of lid sections allows a user to adjust an overall size of the box.

In a further embodiment of the present invention, at least one of the plurality of box sections comprises a base panel adjoined to first and second wall panels so as to form a corner box section.

In yet a further embodiment, the base panel of the corner box section is adjoined to the first and second wall panels at approximately 90 degree angles, and the first wall panel is adjoined to the second wall panel at an approximately 90 degree angle.

In still a further embodiment, the size adjustable box further comprises a first strip member attached to a first one of the plurality of box sections and a second strip member attached to a second one of the plurality of box sections, the first and second strip members acting as guide rails for regulating a sliding of the first one of the plurality of box sections relative to the second one of the plurality of box sections.

In yet a further embodiment, the first strip member comprises a first set of slots formed therein and the second strip member comprises a second set of slots formed therein, and wherein respective ones of the first set of slots are configured to be aligned with respective ones of the second set of slots during the size adjustment of the box by the user.

In still a further embodiment, the size adjustable box further comprises a box locking strip configured to be inserted into one of the first set of slots in the first strip member and one of the second set of slots in the second strip member so as to lock the first one of the plurality of box sections in place relative to the second one of the plurality of box sections.

In yet a further embodiment, at least one of the plurality of lid sections comprises a top panel adjoined to first and second wall panels so as to form a corner lid section.

In still a further embodiment, the top panel of the corner lid section is adjoined to the first and second wall panels at approximately 90 degree angles, and the first wall panel is adjoined to the second wall panel at an approximately 90 degree angle.

In yet a further embodiment, the size adjustable box further comprises a first strip member attached to a first one of the plurality of lid sections and a second strip member attached to a second one of the plurality of lid sections, the first and second strip members acting as guide rails for regulating a sliding of the first one of the plurality of lid sections relative to the second one of the plurality of lid sections.

In still a further embodiment, the first strip member comprises a first set of slots formed therein and the second strip member comprises a second set of slots formed therein, and wherein respective ones of the first set of slots are configured to be aligned with respective ones of the second set of slots during the size adjustment of the lid by the user.

In yet a further embodiment, the size adjustable box further comprises a lid locking strip configured to be inserted into one of the first set of slots in the first strip member and one of the second set of slots in the second strip member so as to lock the first one of the plurality of lid sections in place relative to the second one of the plurality of lid sections.

In still a further embodiment, the plurality of box sections comprise four corner box sections slidably adjustable relative to one another, and wherein the plurality of lid sections comprise four corner lid sections slidably adjustable relative to one another.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
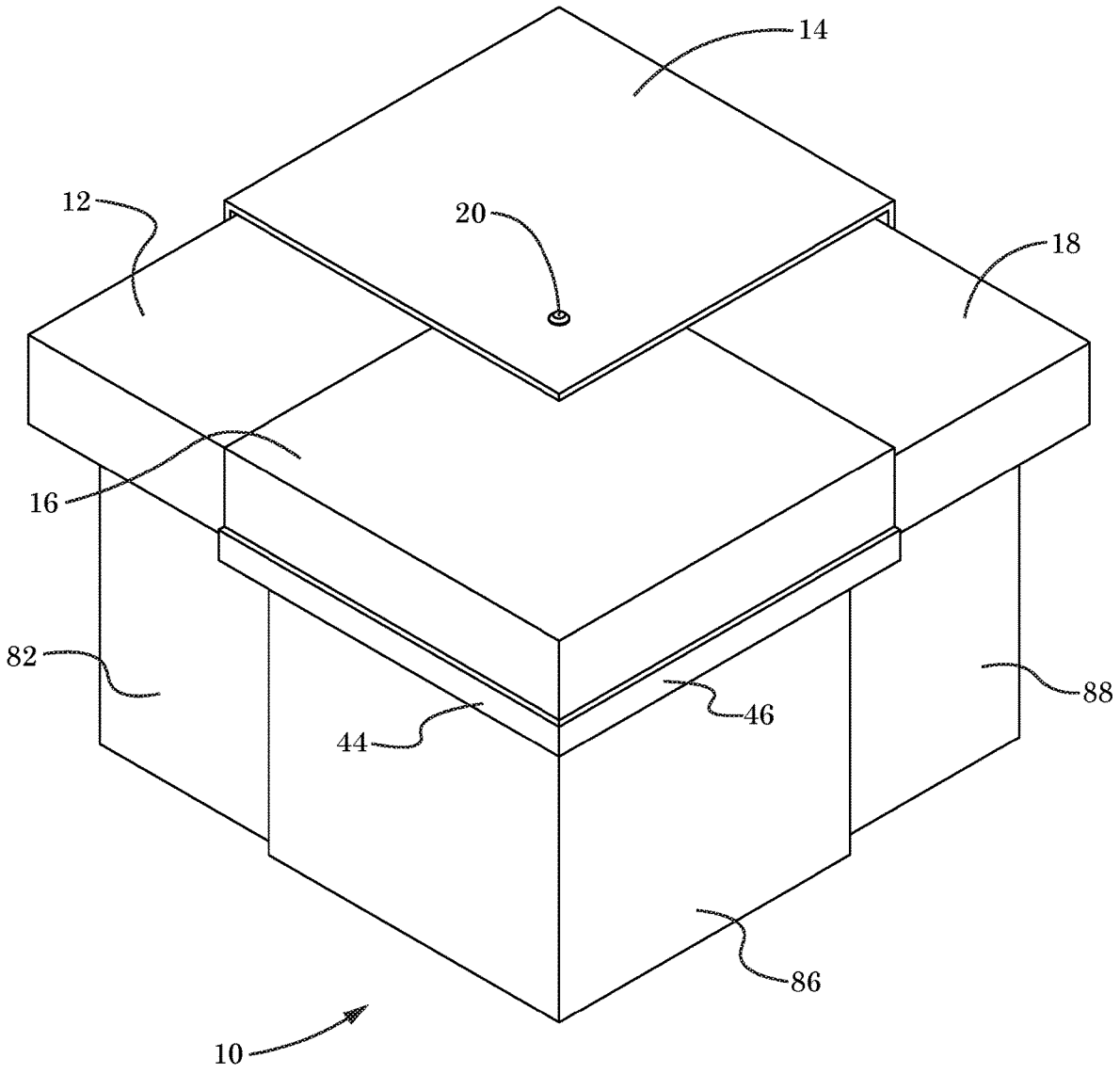
FIG. 1 is a top perspective view of a size adjustable box, according to an illustrative embodiment of the invention.
Figure 2:
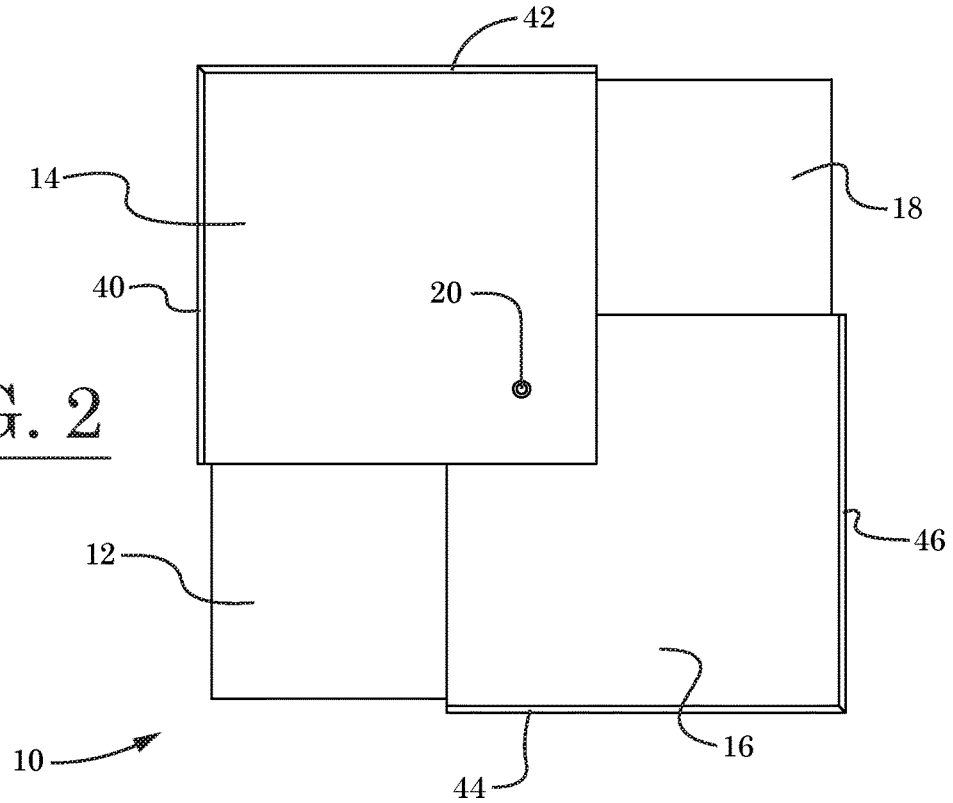
FIG. 2 is a top plan view of the size adjustable box of FIG. 1.
Figure 3:
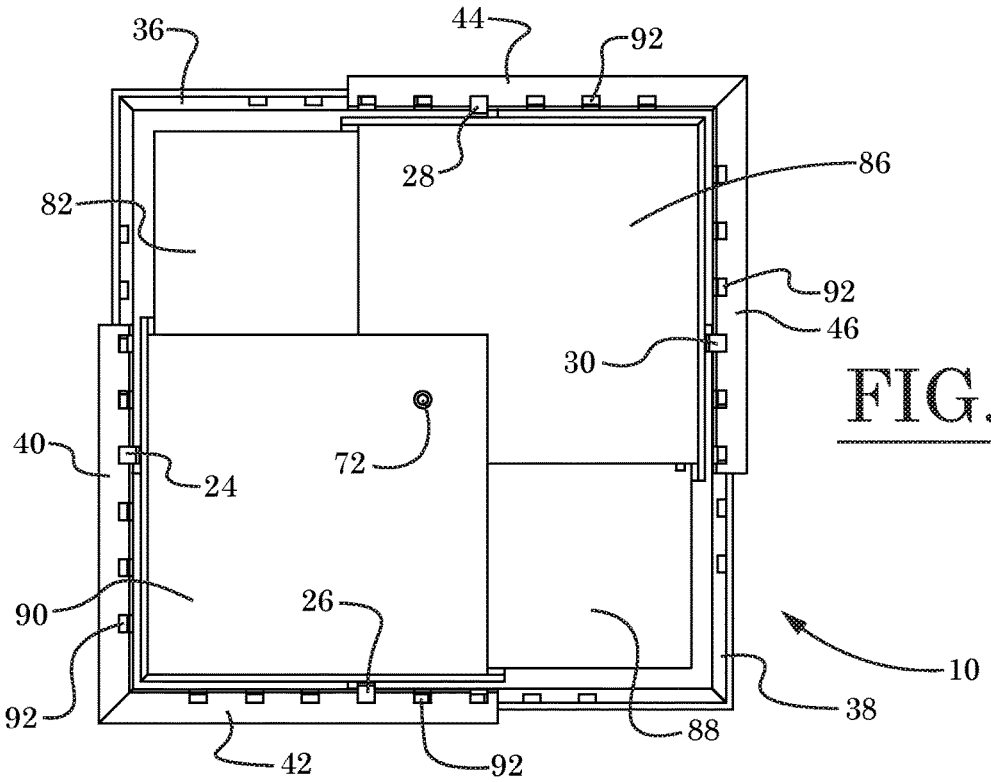
FIG. 3 is a bottom plan view of the size adjustable box of FIG. 1.
Figure 4:
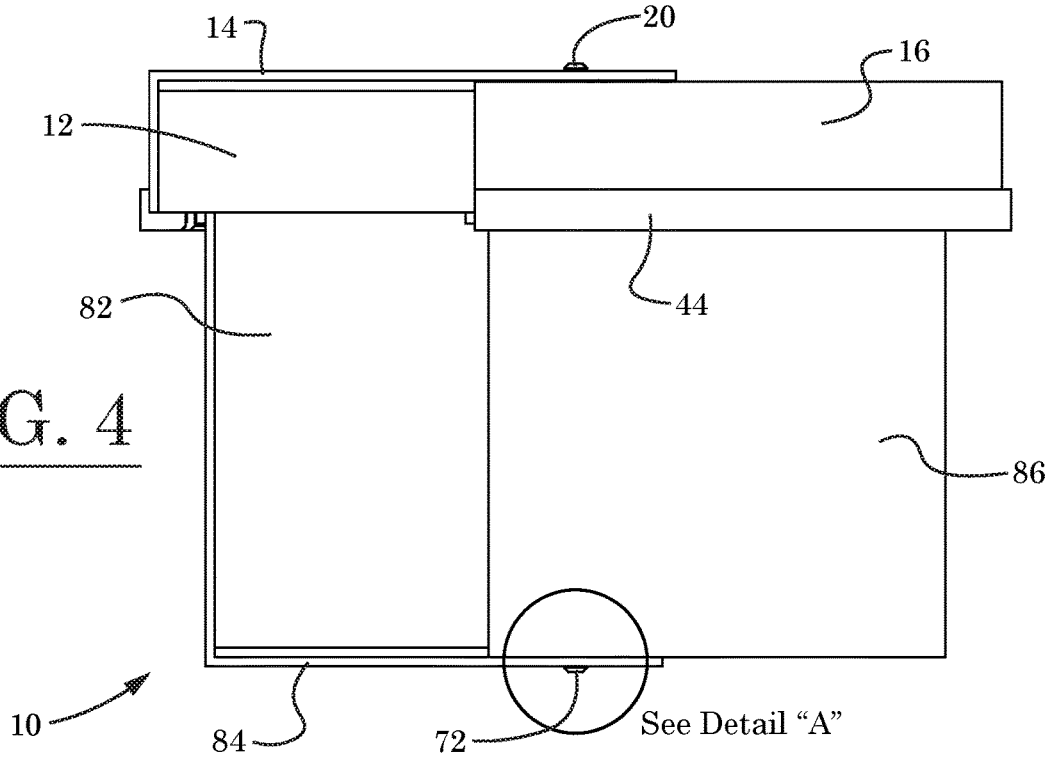
FIG. 4 is a front elevational view of the size adjustable box of FIG. 1.
Figure 5:
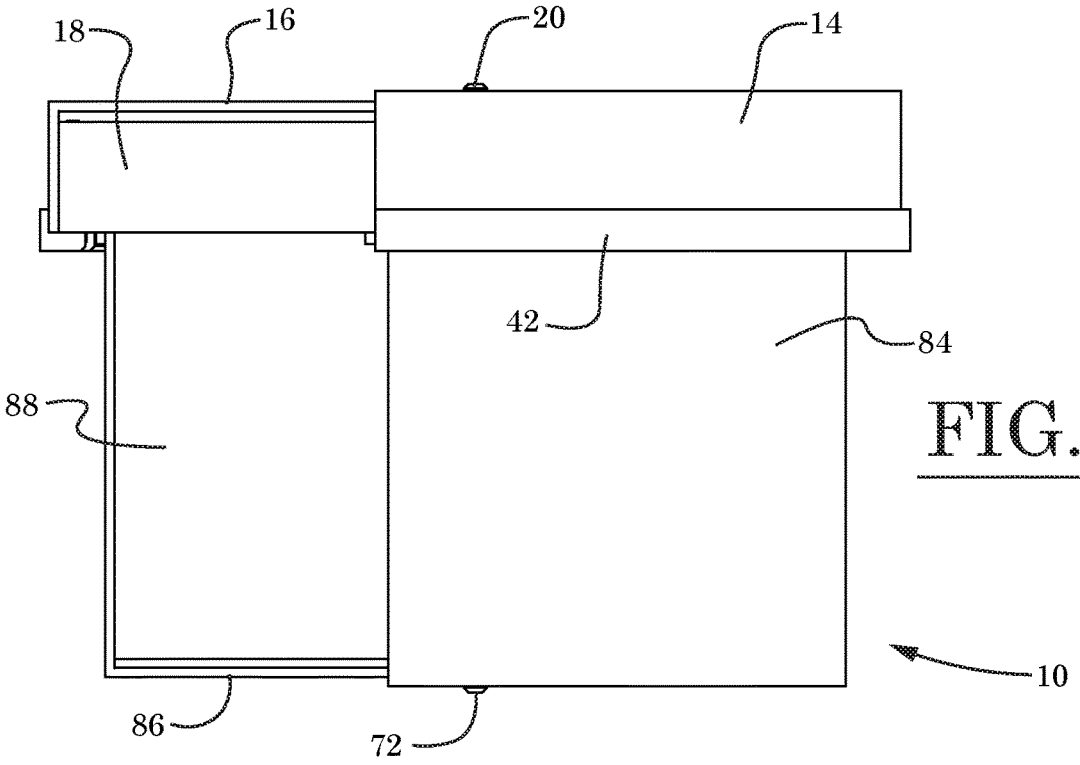
FIG. 5 is a rear elevational view of the size adjustable box of FIG. 1.
Figure 6:
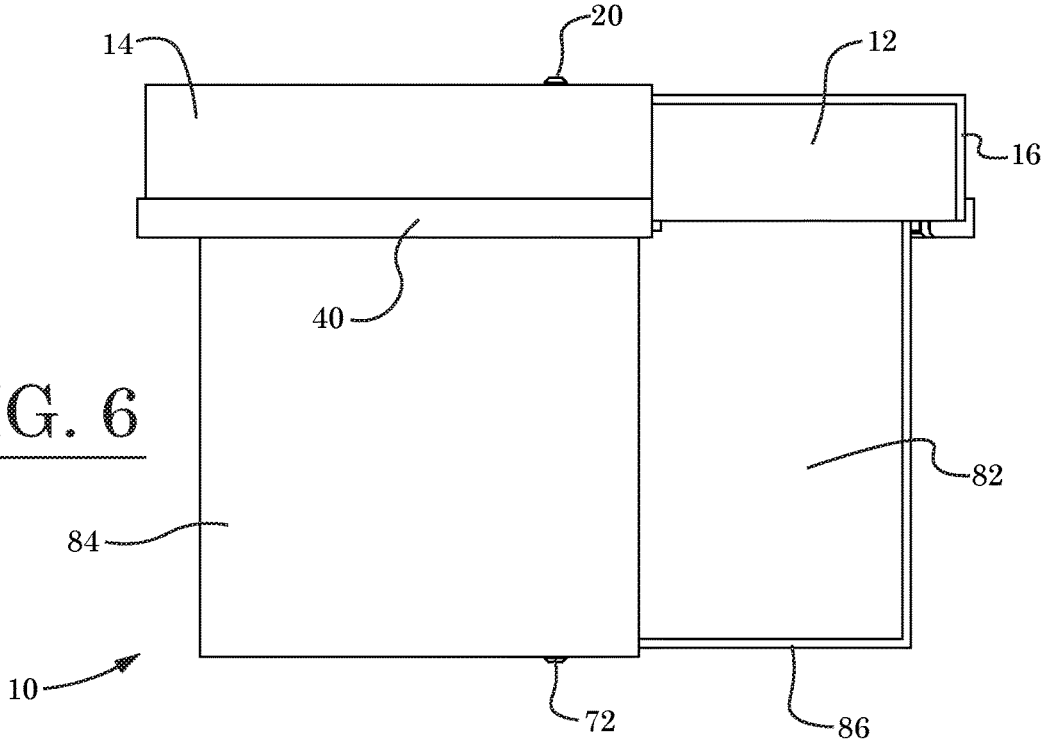
FIG. 6 is a first side elevational view of the size adjustable box of FIG. 1.
Figure 7:
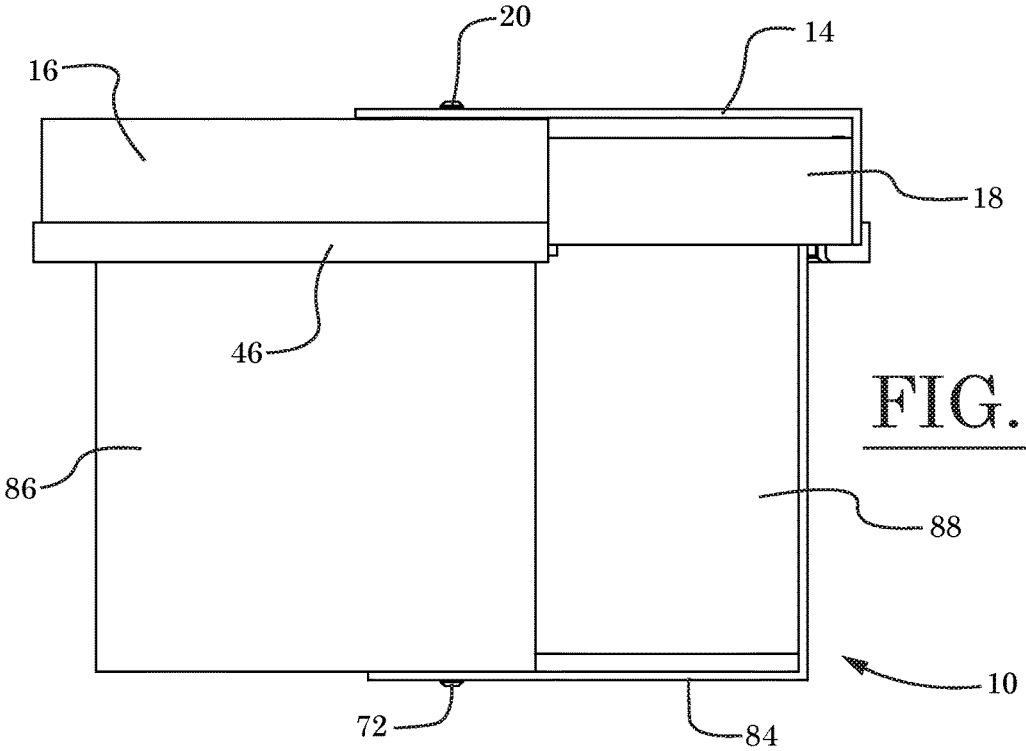
FIG. 7 is a second side elevational view of the size adjustable box of FIG. 1.

An illustrative embodiment of a size adjustable box is seen generally at 10 in FIGS. 1-9, 11, and 12. Initially, with combined reference to FIGS. 1 and 9, it can be seen that the illustrative size adjustable box 10 generally comprises a plurality of box sections 82, 84, 86, 88 slidably adjustable relative to one another, the plurality of box sections 82, 84, 86, 88 configured to collectively define a box interior and an upper box rim; and a plurality of lid sections 12, 14, 16, 18 slidably adjustable relative to one another, the plurality of lid sections 12, 14, 16, 18 configured to be received on the upper box rim so as to generally enclose the box interior. The slidable adjustability of the plurality of box sections 82, 84, 86, 88 and the plurality of lid sections 12, 14, 16, 18 allows a user to adjust an overall size of the box (see FIG. 13).

Now, referring particularly to FIGS. 1 and 9-12, the box portion of the illustrative size adjustable box 10 will be described. In the illustrative embodiment, each of the plurality of box sections 82, 84, 86, 88 comprises a base panel adjoined to first and second wall panels so as to form a corner box section (see FIG. 9). As shown in the figures, in the illustrative embodiment, the base panel of each corner box section 82, 84, 86, 88 is adjoined to the first and second wall panels at approximately 90 degree angles, and the first wall panel is adjoined to the second wall panel at an approximately 90 degree angle.

Figure 9:
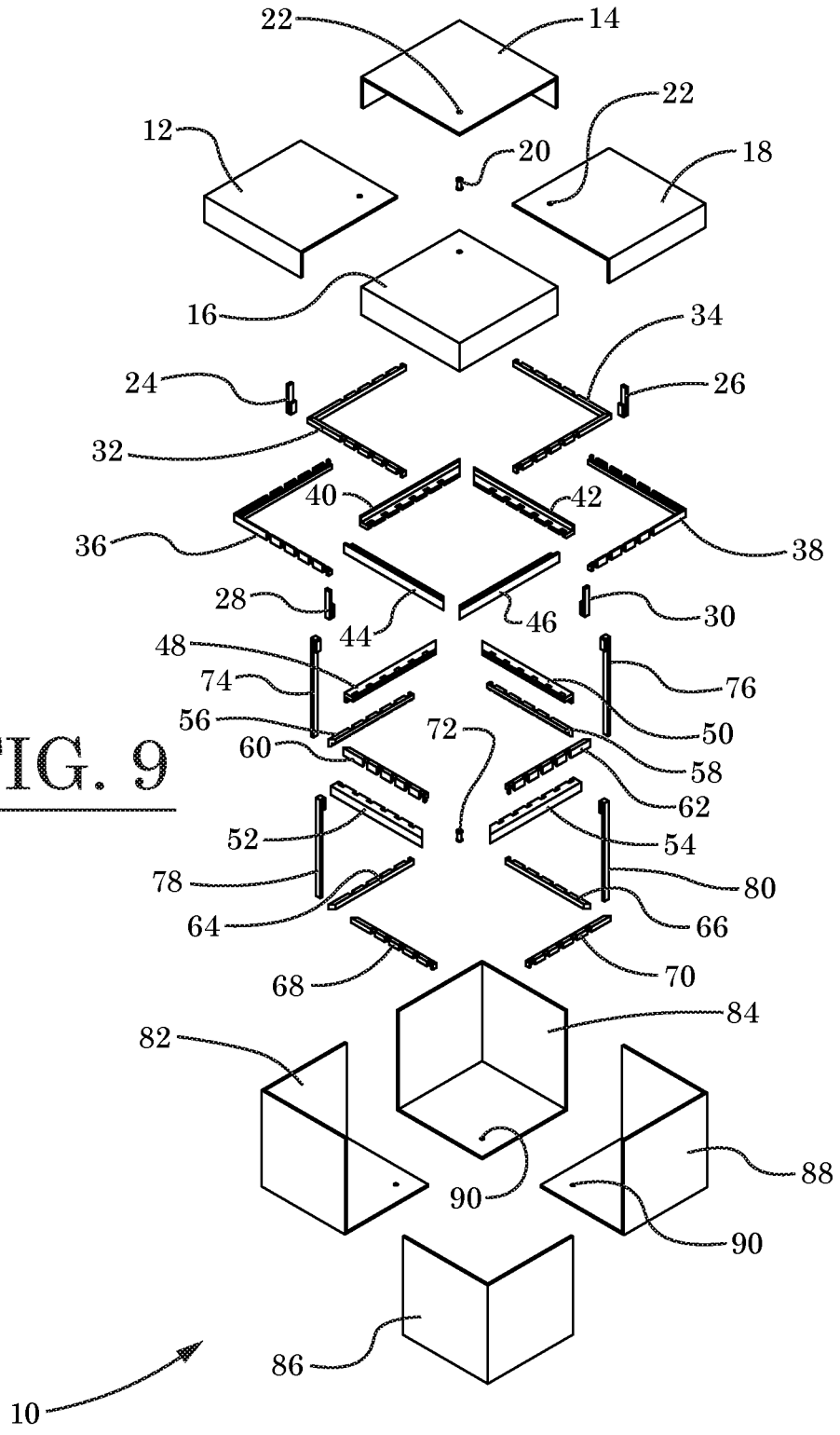
FIG. 9 is an exploded perspective view of the size adjustable box of FIG. 1.
Figure 10:
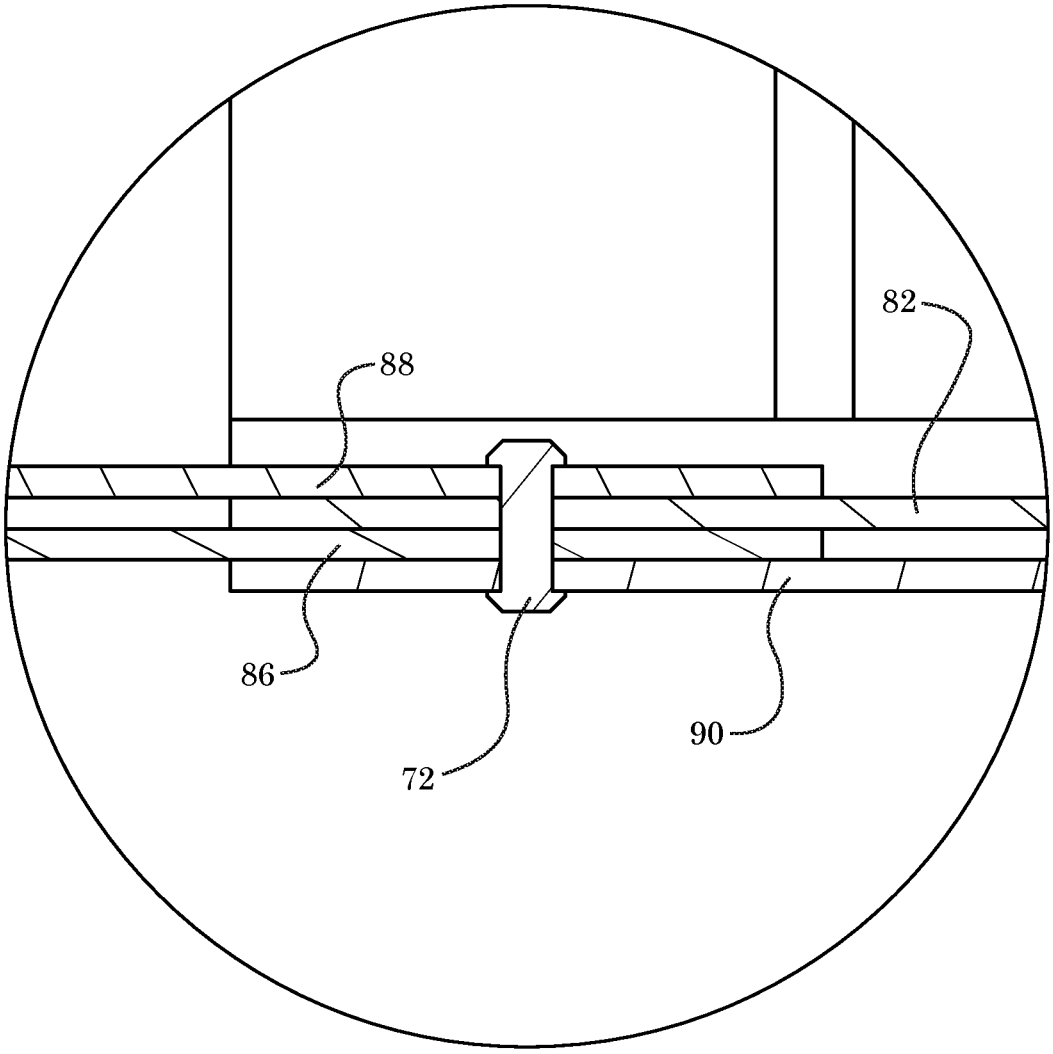
FIG. 10 is an enlarged sectional view of the bottom pin connection of the size adjustable box depicted in FIG. 4 (Detail "A")
Figure 11:
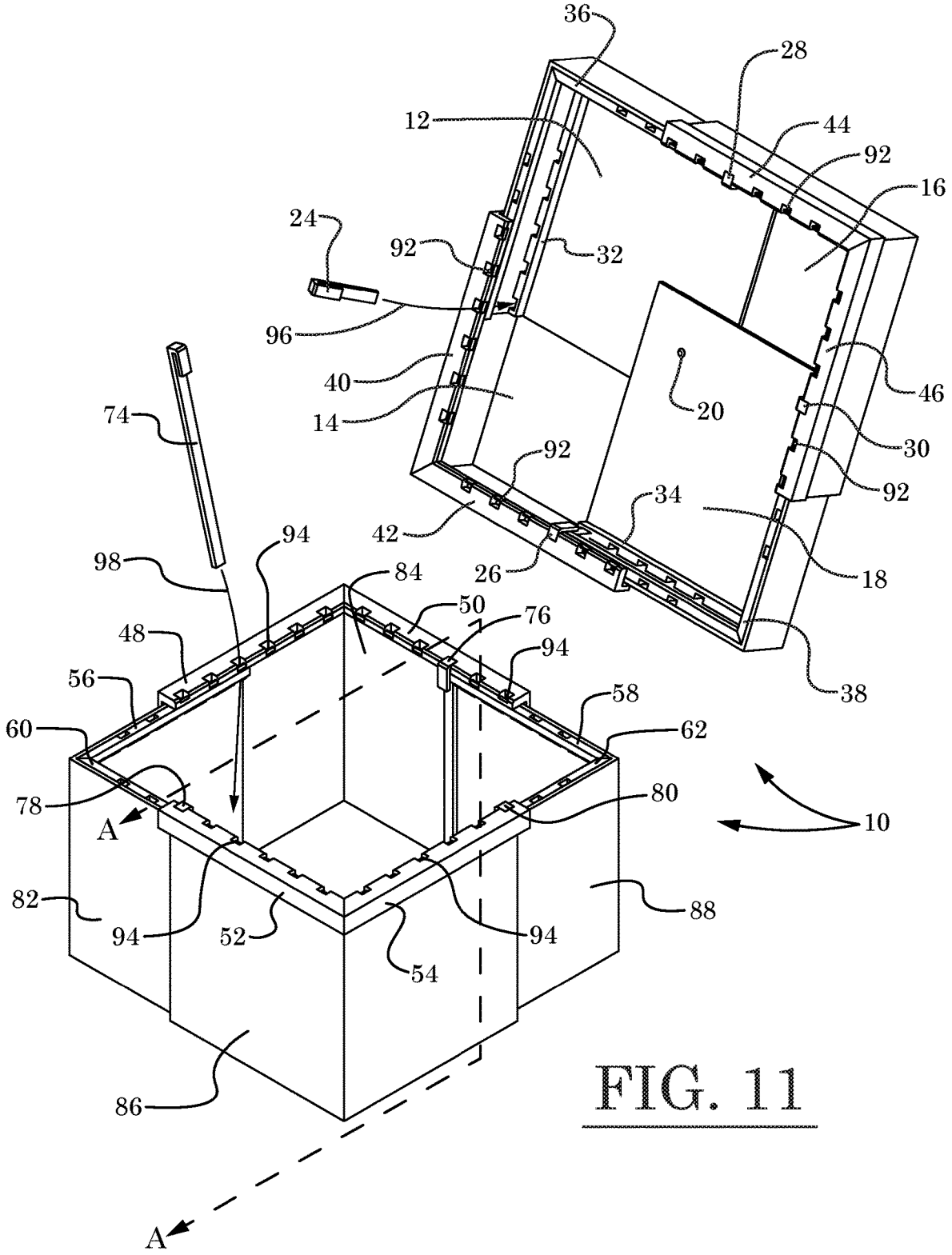
FIG. 11 is a perspective view of the size adjustable box of FIG. 1 with the lid portion removed from the box portion, wherein the insertion of a lid locking strip and a box locking strip is illustrated.

Also, in the illustrative embodiment, the box portion of the size adjustable box 10 further comprises first and second outside rim strip members 48, 50 attached to the upper edge of the box section 84 (see FIGS. 9 and 11). In the illustrative embodiment, the first outside rim strip member 48 is oriented at an approximately 90 degree angle relative to the second outside rim strip member 50. Similarly, in the illustrative embodiment, the box portion of the size adjustable box 10 further comprises third and fourth outside rim strip members 52, 54 attached to the upper edge of the box section 86 (see FIGS. 9 and 11). In the illustrative embodiment, the third outside rim strip member 52 is oriented at an approximately 90 degree angle relative to the fourth outside rim strip member 54. Turning again to the illustrative embodiment of FIGS. 9 and 11, the box portion of the size adjustable box 10 further comprises first and second inside rim strip members 56, 60 attached adjacent to the upper edge of the box section 82. In the illustrative embodiment, the first inside rim strip member 56 is oriented at an approximately 90 degree angle relative to the second inside rim strip member 60. Similarly, in the illustrative embodiment, the box portion of the size adjustable box 10 further comprises third and fourth inside rim strip members 58, 62 attached adjacent to the upper edge of the box section 88 (see FIGS. 9 and 11). In the illustrative embodiment, the third inside rim strip member 58 is oriented at an approximately 90 degree angle relative to the fourth inside rim strip member 62. The inside and outside rim strip members 48, 50, 52, 54, 56, 58, 60, 62 act as guide rails for regulating a sliding of the box sections 82, 84, 86, 88 relative to one another.

Referring again to FIGS. 9 and 12, in the illustrative embodiment, the box portion of the size adjustable box 10 further comprises first and second lower strip members 64, 68 attached to the inside bottom seam of the box section 82 where the wall panels adjoin the base panel. In the illustrative embodiment, the first lower strip member 64 is oriented at an approximately 90 degree angle relative to the second lower strip member 68. Similarly, in the illustrative embodiment, the box portion of the size adjustable box 10 further comprises third and fourth lower strip members 66, 70 attached to the inside bottom seam of the box section 88 where the wall panels adjoin the base panel (see FIGS. 9 and 12). In the illustrative embodiment, the third lower strip member 66 is oriented at an approximately 90 degree angle relative to the fourth lower strip member 70. Advantageously, the lower strip members 64, 66, 68, 70 increase the structural rigidity of the bottom portion of the box.

Figure 12:
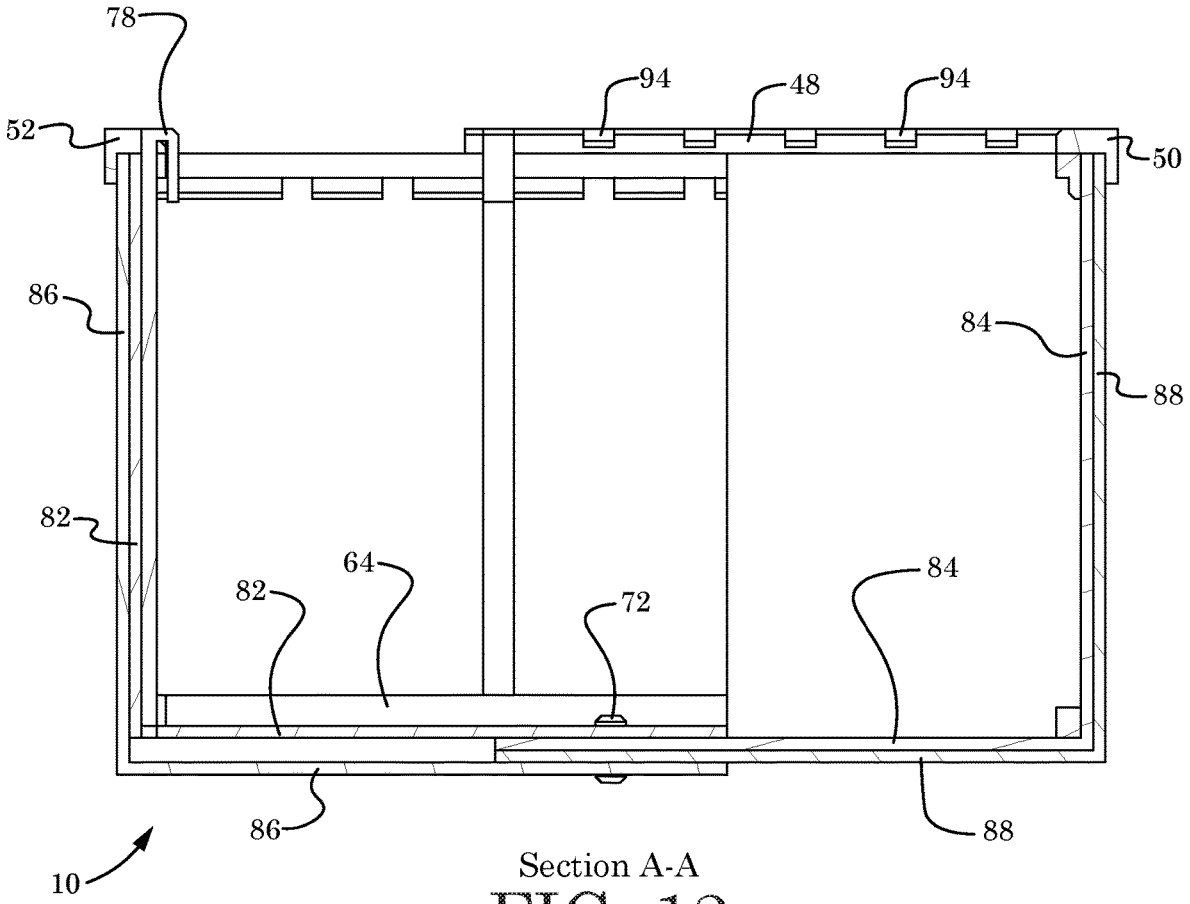
FIG. 12 is a transverse sectional view cut through the box portion of the size adjustable box of FIG. 1, wherein the section is generally cut along the cutting-plane line A-A in FIG. 11.

In the illustrative embodiment, with collective reference to FIGS. 9, 11, and 12, it can be seen that the strip members 48, 50, 52, 54, 56, 58, 60, 62, 64, 66, 68, 70 are all provided with sets of slots 94 formed therein for receiving box locking strips 74, 76, 78, 80. More specifically, as best shown in FIG. 11, respective ones of a first set of slots 94 in a first box section are configured to be aligned with respective ones of a second set of slots 94 in a second box section during the size adjustment of the box by the user. In the illustrative embodiment, to fix the position of the first box section 82 relative to the second box section 84, the first box locking strip 74 is inserted into a selected strip slot 94 of the second box section 84 and selected strip slots 94 of the first box section 82 that correspond to a desired dimension of the box portion of the size adjustable box 10. In FIG. 11, the insertion of the first box locking strip 74 into the strip slots 94 is diagrammatically represented by the arrow 98. Similarly, to fix the position of the second box section 84 relative to the fourth box section 88, the second box locking strip 76 is inserted into a selected strip slot 94 of the second box section 84 and selected strip slots 94 of the fourth box section 88 that correspond to a desired dimension of the box portion of the size adjustable box 10. To fix the position of the first box section 82 relative to the third box section 86, the third box locking strip 78 is inserted into a selected strip slot 94 of the third box section 86 and selected strip slots 94 of the first box section 82 that correspond to a desired dimension of the box portion of the size adjustable box 10. Finally, to fix the position of the third box section 86 relative to the fourth box section 88, the fourth box locking strip 80 is inserted into a selected strip slot 94 of the third box section 86 and selected strip slots 94 of the fourth box section 88 that correspond to a desired dimension of the box portion of the size adjustable box 10. In the illustrated embodiment, to ensure that the box sections 82, 84, 86, 88 are securely attached to one another, each of the box locking strips 74, 76, 78, 80 extends through the slots 94 in the paired upper inside and outside rim strip members 48, 56 or 50, 58 or 52, 60 or 54, 62 down to the slot 94 in one of the lower strip members 64, 66, 68, 70.

As shown in FIG. 9, in the illustrative embodiment, each of the box sections 82, 84, 86, 88 comprises a hole 90 located near the inner corner of the section base panel for receiving a bottom pin 72. The bottom pin 72 secures the central bottom portion of the box sections 82, 84, 86, 88 together (see FIGS. 8, 10, and 12) so that the bottom of the size adjustable box 10 is structurally rigid for securely holding the contents of the box therein.

Next, with particular reference to FIGS. 1, 8, 9, and 11 the lid portion of the illustrative size adjustable box 10 will be explained. In the illustrative embodiment, each of the plurality of lid sections 12, 14, 16, 18 comprises a top panel adjoined to first and second wall panels so as to form a corner lid section (see FIG. 9). As shown in the figures, in the illustrative embodiment, the top panel of each corner lid section 12, 14, 16, 18 is adjoined to the first and second wall panels at approximately 90 degree angles, and the first wall panel is adjoined to the second wall panel at an approximately 90 degree angle.

Also, in the illustrative embodiment, the lid portion of the size adjustable box 10 further comprises first and second outside rim strip members 40, 42 attached to the lower edge of the lid section 14 (see FIGS. 9 and 11). In the illustrative embodiment, the first outside rim strip member 40 is oriented at an approximately 90 degree angle relative to the second outside rim strip member 42. Similarly, in the illustrative embodiment, the size adjustable box 10 further comprises third and fourth outside rim strip members 44, 46 attached to the lower edge of the lid section 16 (see FIGS. 9 and 11). In the illustrative embodiment, the third outside rim strip member 44 is oriented at an approximately 90 degree angle relative to the fourth outside rim strip member 46. Turning again to the illustrative embodiment of FIGS. 9 and 11, the lid portion of the size adjustable box 10 further comprises a first inside rim L-shaped strip member 36 attached adjacent to the lower edge of the lid section 12. In the illustrative embodiment, the two sections of the first L-shaped strip member 36 are oriented at approximately 90 degrees relative to one another. Similarly, in the illustrative embodiment, the lid portion of the size adjustable box 10 further comprises a second inside rim L-shaped strip member 38 attached adjacent to the lower edge of the lid section 18. In the illustrative embodiment, the two sections of the second L-shaped strip member 38 are oriented at approximately 90 degrees relative to one another. The inside and outside rim strip members 36, 38, 40, 42, 44, 46 act as guide rails for regulating a sliding of the lid sections 12, 14, 16, 18 relative to one another.

Referring again to FIGS. 9 and 11, in the illustrative embodiment, the lid portion of the size adjustable box 10 further comprises a first upper L-shaped strip member 32 attached to the inside top seam of the lid section 12 where the wall panels adjoin the top panel. In the illustrative embodiment, the two sections of the first L-shaped strip member 32 are oriented at approximately 90 degrees relative to one another. Similarly, in the illustrative embodiment, the lid portion of the size adjustable box 10 further comprises a second upper L-shaped strip member 34 attached to the inside top seam of the lid section 18 where the wall panels adjoin the top panel (see FIGS. 9 and 11). In the illustrative embodiment, the two sections of the second L-shaped strip member 34 are oriented at approximately 90 degrees relative to one another. Advantageously, the first and second upper strip members 32, 34 increase the structural rigidity of the top portion of the box lid.

Figure 8:
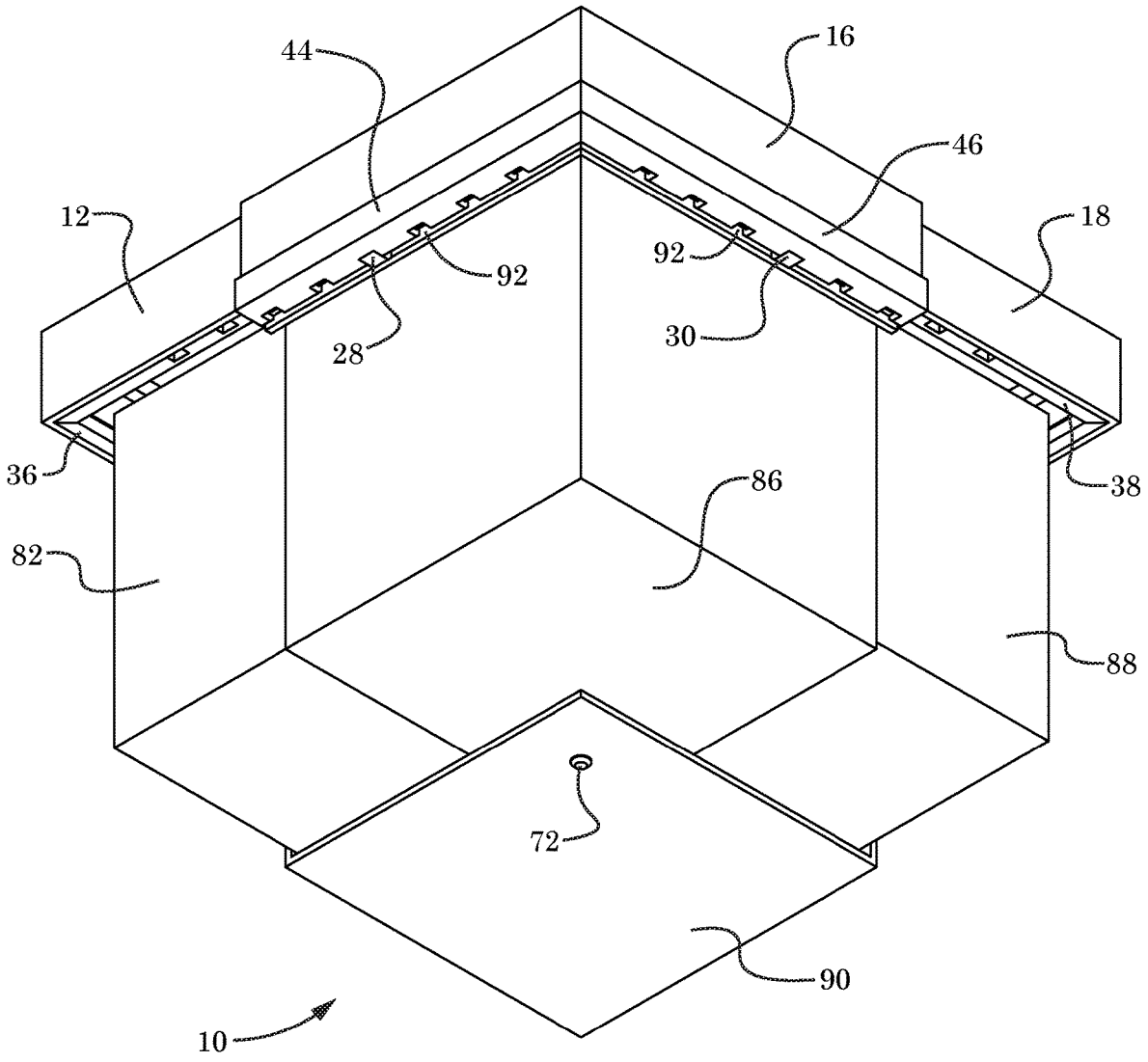
FIG. 8 is a bottom perspective view of the size adjustable box of FIG. 1.

In the illustrative embodiment, with collective reference to FIGS. 8, 9, and 11, it can be seen that the strip members 32, 34, 36, 38, 40, 42, 44, 46 are all provided with sets of slots 92 formed therein for receiving lid locking strips 24, 26, 28, 30. More specifically, as best shown in FIG. 11, respective ones of a first set of slots 92 in a first lid section are configured to be aligned with respective ones of a second set of slots 92 in a second lid section during the size adjustment of the lid by the user. In the illustrative embodiment, to fix the position of the first lid section 12 relative to the second lid section 14, the first lid locking strip 24 is inserted into a selected strip slot 92 of the second lid section 14 and selected strip slots 92 of the first lid section 12 that correspond to a desired dimension of the lid portion of the size adjustable box 10. In FIG. 11, the insertion of the first lid locking strip 24 into the strip slots 92 is diagrammatically represented by the arrow 96. Similarly, to fix the position of the second lid section 14 relative to the fourth lid section 18, the second lid locking strip 26 is inserted into a selected strip slot 92 of the second lid section 14 and selected strip slots 92 of the fourth lid section 18 that correspond to a desired dimension of the lid portion of the size adjustable box 10. To fix the position of the first lid section 12 relative to the third lid section 16, the third lid locking strip 28 is inserted into a selected strip slot 92 of the third lid section 16 and selected strip slots 92 of the first lid section 12 that correspond to a desired dimension of the lid portion of the size adjustable box 10. Finally, to fix the position of the third lid section 16 relative to the fourth lid section 18, the fourth lid locking strip 30 is inserted into a selected strip slot 92 of the third lid section 16 and selected strip slots 92 of the fourth lid section 18 that correspond to a desired dimension of the lid portion of the size adjustable box 10. In the illustrated embodiment, to ensure that the lid sections 12, 14, 16, 18 are securely attached to one another, each of the lid locking strips 24, 26, 28, 30 extends through the slots 92 in the paired lower inside and outside rim strip members 36, 40 or 36, 44 or 38, 42 or 38, 46 up to the slot 92 in one of the upper strip members 32, 34.

As shown in FIG. 9, in the illustrative embodiment, each of the lid sections 12, 14, 16, 18 comprises a hole 22 located near the inner corner of the section top panel for receiving a top pin 20. The top pin 20 secures the central top portion of the lid sections 12, 14, 16, 18 together (see FIGS. 1 and 11) so that the top lid of the size adjustable box 10 is structurally rigid.

In the illustrative embodiment, during the initial step of assembling the size adjustable box 10, a user uses the box locking strips 74, 76, 78, 80 to fix the positions of the box sections 82, 84, 86, 88 relative to one another. Then, the user pins the center portions of the box sections 82, 84, 86, 88 together using the bottom pin 72. After this step, the user uses the lid locking strips 24, 26, 28, 30 to fix the positions of the lid sections 12, 14, 16, 18 relative to one another. Finally, the user pins the center portions of the lid sections 12, 14, 16, 18 together using the top pin 20.

Figure 13:
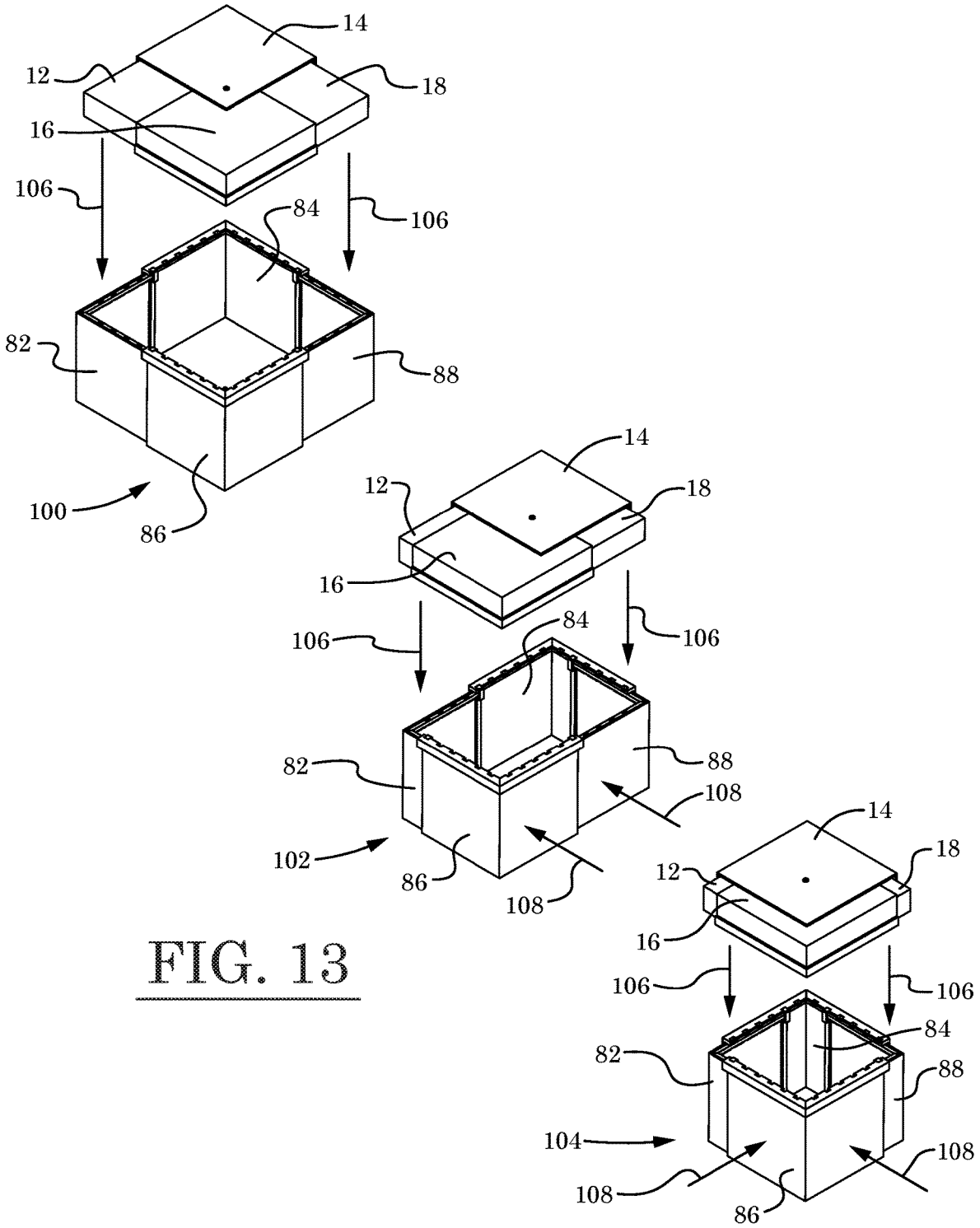
FIG. 13 is a perspective view depicting a plurality of different sized boxes that are able to be formed using the size adjustable box of FIG. 1.

FIG. 13 illustrates exemplary boxes 100, 102, 104 of different sizes that may be formed using the size adjustable box 10 described in the illustrative embodiment. The first exemplary box 100 in FIG. 13 is a large square box that is formed when the box sections 82, 84, 86, 88 and lid sections 12, 14, 16, 18 are almost fully extended relative to one another. The second exemplary box 102 in FIG. 13 is a rectangular box that is formed when two pairs of the box sections 82, 84, 86, 88 and two pairs of the lid sections 12, 14, 16, 18 are almost fully extended relative to one another, but the other two pairs of the box sections 82, 84, 86, 88 and the other two pairs of the lid sections 12, 14, 16, 18 are relatively close together. The third exemplary box 104 in FIG. 13 is a small square box that is formed when the box sections 82, 84, 86, 88 and lid sections 12, 14, 16, 18 are all relatively close together. In FIG. 13, the downward arrows 106 diagrammatically represent the insertion of the lid portions on the box portions of the exemplary boxes 100, 102, 104. In FIG. 13, the transverse arrows 108 diagrammatically represent the size adjustment of the exemplary boxes 102, 104.

In the illustrative embodiment, the lid portion of the size adjustable box 10 may be attached to the box portion of the size adjustable box 10 by using various fastening means, such as tape, hook-and-loop fastener devices, or magnetic devices.

In the illustrative embodiment, the box sections 82, 84, 86, 88 and the lid sections 12, 14, 16, 18 of the size adjustable box 10 can be formed using various materials, such as corrugated cardboard, chipboard, acrylonitrile butadiene styrene (ABS), Poly(methyl methacrylate) or Plexiglas®, acrylic, glass, and virtually any other material with enough strength and thickness to hold the sections together.

It is readily apparent that the aforedescribed size adjustable box 10 offers numerous advantages. First, the size adjustable box 10 can be customized by a user to store items safely and securely. Secondly, the size adjustable box 10 allows a user to easily expand and reduce the dimensions of the box. Finally, the size adjustable box 10 is able to be adapted for use in a myriad of different applications.

In one or more alternative embodiments, the lid portion and the box portion have the same height or depth so that the two portions can be interchangeably used as either the lid or the box.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A size adjustable box, comprising:

a plurality of box sections slidably adjustable relative to one another, the plurality of box sections configured to collectively define a box interior and an upper box rim;

a plurality of lid sections slidably adjustable relative to one another, the plurality of lid sections configured to be received on the upper box rim so as to generally enclose the box interior;

a first strip member attached to a first one of the plurality of box sections and a second strip member attached to a second one of the plurality of box sections, the first and second strip members acting as guide rails for regulating a sliding of the first one of the plurality of box sections relative to the second one of the plurality of box sections, the first strip member comprising a first set of slots formed therein and the second strip member comprising a second set of slots formed therein, and respective ones of the first set of slots being configured to be aligned with respective ones of the second set of slots during the size adjustment of the box by a user; and a box locking strip configured to be inserted into one of the first set of slots in the first strip member and one of the second set of slots in the second strip member so as to lock the first one of the plurality of box sections in place relative to the second one of the plurality of box sections;

wherein the slidable adjustability of the plurality of box sections and the plurality of lid sections allows the user to adjust an overall size of the box.

2. The size adjustable box according to claim 1, wherein at least one of the plurality of box sections comprises a base panel adjoined to first and second wall panels so as to form a corner box section.

3. The size adjustable box according to claim 2, wherein the base panel of the corner box section is adjoined to the first and second wall panels at approximately 90 degree angles, and the first wall panel is adjoined to the second wall panel at an approximately 90 degree angle.

4. The size adjustable box according to claim 1, wherein at least one of the plurality of lid sections comprises a top panel adjoined to first and second wall panels so as to form a corner lid section.

5. The size adjustable box according to claim 4, wherein the top panel of the corner lid section is adjoined to the first and second wall panels at approximately 90 degree angles, and the first wall panel is adjoined to the second wall panel at an approximately 90 degree angle.

6. The size adjustable box according to claim 1, further comprising a third strip member attached to a first one of the plurality of lid sections and a fourth strip member attached to a second one of the plurality of lid sections, the third and fourth strip members acting as guide rails for regulating a sliding of the first one of the plurality of lid sections relative to the second one of the plurality of lid sections.

7. The size adjustable box according to claim 6, wherein the third strip member comprises a third set of slots formed therein and the fourth strip member comprises a fourth set of slots formed therein, and wherein respective ones of the third set of slots are configured to be aligned with respective ones of the fourth set of slots during the size adjustment of the lid by the user.

8. The size adjustable box according to claim 7, further comprising a lid locking strip configured to be inserted into one of the third set of slots in the third strip member and one of the fourth set of slots in the fourth strip member so as to lock the first one of the plurality of lid sections in place relative to the second one of the plurality of lid sections.

9. The size adjustable box according to claim 1, wherein the plurality of box sections comprise four corner box sections slidably adjustable relative to one another, and wherein the plurality of lid sections comprise four corner lid sections slidably adjustable relative to one another.

10. A size adjustable box, comprising:

a plurality of box sections slidably adjustable relative to one another, the plurality of box sections configured to collectively define a box interior and an upper box rim;

a plurality of lid sections slidably adjustable relative to one another, the plurality of lid sections configured to be received on the upper box rim so as to generally enclose the box interior;

a first strip member attached to a first one of the plurality of lid sections and a second strip member attached to a second one of the plurality of lid sections, the first and second strip members acting as guide rails for regulating a sliding of the first one of the plurality of lid sections relative to the second one of the plurality of lid sections, the first strip member comprising a first set of slots formed therein and the second strip member comprising a second set of slots formed therein, and respective ones of the first set of slots being configured to be aligned with respective ones of the second set of slots during the size adjustment of the lid by a user; and a lid locking strip configured to be inserted into one of the first set of slots in the first strip member and one of the second set of slots in the second strip member so as to lock the first one of the plurality of lid sections in place relative to the second one of the plurality of lid sections;

wherein the slidable adjustability of the plurality of box sections and the plurality of lid sections allows the user to adjust an overall size of the box.

11. The size adjustable box according to claim 10, wherein at least one of the plurality of box sections comprises a base panel adjoined to first and second wall panels so as to form a corner box section.

12. The size adjustable box according to claim 11, wherein the base panel of the corner box section is adjoined to the first and second wall panels at approximately 90 degree angles, and the first wall panel is adjoined to the second wall panel at an approximately 90 degree angle.

13. The size adjustable box according to claim 10, further comprising a third strip member attached to a first one of the plurality of box sections and a fourth strip member attached to a second one of the plurality of box sections, the third and fourth strip members acting as guide rails for regulating a sliding of the first one of the plurality of box sections relative to the second one of the plurality of box sections.

14. The size adjustable box according to claim 13, wherein the third strip member comprises a third set of slots formed therein and the fourth strip member comprises a fourth set of slots formed therein, and wherein respective ones of the third set of slots are configured to be aligned with respective ones of the fourth set of slots during the size adjustment of the box by the user.

15. The size adjustable box according to claim 14, further comprising a box locking strip configured to be inserted into one of the third set of slots in the third strip member and one of the fourth set of slots in the fourth strip member so as to lock the first one of the plurality of box sections in place relative to the second one of the plurality of box sections.

16. The size adjustable box according to claim 10, wherein at least one of the plurality of lid sections comprises a top panel adjoined to first and second wall panels so as to form a corner lid section.

17. The size adjustable box according to claim 16, wherein the top panel of the corner lid section is adjoined to the first and second wall panels at approximately 90 degree angles, and the first wall panel is adjoined to the second wall panel at an approximately 90 degree angle.

18. A size adjustable box, comprising:

a plurality of box sections slidably adjustable relative to one another, the plurality of box sections configured to collectively define a box interior and an upper box rim, at least a first one of the plurality of box sections being slidable in a length direction of the box, and at least a second one of the plurality of box sections being slidable in a width direction of the box; and a first strip member attached to the first one of the plurality of box sections and a second strip member attached to a third one of the plurality of box sections, the first and second strip members acting as guide rails for regulating a sliding of the first one of the plurality of box sections relative to the third one of the plurality of box sections, the first strip member comprising a first set of slots formed therein and the second strip member comprising a second set of slots formed therein, and respective ones of the first set of slots being configured to be aligned with respective ones of the second set of slots during the size adjustment of the box by a user;

wherein the slidable adjustability of the plurality of box sections allows the user to adjust an overall length and an overall width of the box.

19. The size adjustable box according to claim 18, further comprising a plurality of lid sections slidably adjustable relative to one another, the plurality of lid sections configured to be received on the upper box rim so as to generally enclose the box interior, at least a first one of the plurality of lid sections being slidable in the length direction of the box, and at least a second one of the plurality of lid sections being slidable in the width direction of the box; and wherein the slidable adjustability of the plurality of lid sections allows the user to adjust an overall length and an overall width of the box.

20. The size adjustable box according to claim 18, wherein at least the first one or the second one of the plurality of box sections comprises a base panel adjoined to first and second wall panels so as to form a corner box section.

* * * * *